United States Patent [19]

Kober et al.

[11] 4,306,885

[45] Dec. 22, 1981

[54] METHOD OF CONDITIONING FLUE GAS

[75] Inventors: Alfred E. Kober, Hopatcong; Ira Kukin, West Orange, both of N.J.

[73] Assignee: Apollo Technologies, Inc., Whippany, N.J.

[21] Appl. No.: 881,896

[22] Filed: Feb. 27, 1978

[51] Int. Cl.[3] ..... B03C 3/01

[52] U.S. Cl. ..... 55/5; 423/215.5

[58] Field of Search ..... 55/5; 423/215.5

[56] References Cited

U.S. PATENT DOCUMENTS

| | | | |
|---|---|---|---|
| 3,284,990 | 11/1966 | Orne | 55/5 |
| 3,960,687 | 6/1976 | Bakke et al. | 55/5 |
| 4,042,348 | 8/1977 | Bennett et al. | 55/5 |
| 4,123,234 | 10/1978 | Vossos | 55/5 |

FOREIGN PATENT DOCUMENTS

| | | | |
|---|---|---|---|
| 884095 | 8/1960 | United Kingdom | 55/73 |

*Primary Examiner*—Richard L. Chiesa

*Attorney, Agent, or Firm*—James & Franklin

[57] ABSTRACT

The collection characteristics of particles entrained in a particle-laden gas for collection by an electrostatic precipitator are improved by injecting finely divided sodium and ammonium phosphate salts into a particle-laden gas stream formed by the burning of coal. Sufficient additive is injected to provide 24–1200 grams per metric ton of coal burned to form the gas. After injection, the stream is directed through a heat exchange means and finally into the precipitator to collect the particles therein.

34 Claims, 2 Drawing Figures

METHOD OF CONDITIONING FLUE GAS

BACKGROUND OF THE INVENTION

This invention relates generally to the separation of particulate material from a gas stream and specifically to a method of chemically conditioning a particle-laden gas stream so that the particles may be efficiently removed in an electric field.

DESCRIPTION OF PRIOR ART

One conventional way of collecting dust particles from a gas stream in which the particles are entrained is by using an electrostatic precipitator. This apparatus utilizes a corona discharge to charge the particles passing through an electrical field established by a plurality of discharge electrode wires suspended by insulators in a plane parallel to a grounded collecting electrode plate. The charged particles are attracted to the collector plate from which they may then be removed by vibrating or rapping the plate. Examples of this type of precipitator are found in U.S. Pat. Nos. 3,109,720 and 3,030,753.

Dust particles have different collection characteristics depending somewhat upon their source. One such characteristic is resistivity which is measured in ohm-centimeters. For example, where the source of particles is a coal-fired boiler, there is usually a predictable relationship between the type of coal burned and the resistivity of the particles in the flue gas. Typically, low sulfur coal, i.e., less than one percent sulfur, produces particles having high resistivity, e.g., $10^{13}$ ohm-centimeters resistivity; coal with 3–5 percent sulfur produces particles having $10^8$–$10^{10}$ ohm-cm resistivity and poor combustion of coal produces particles having $10^4$–$10^5$ ohm-cm resistivity.

It has been found heretofore that the most efficient collection or precipitation of particles occurs when their resistivity is about $10^8$–$10^{10}$ ohm-centimeters. When the resistivity is lower than this, e.g., in the collection of highly conductive dusts, the dust particle loses it charge immediately upon reaching the collecting electrode. Once the charge is lost, the particle reentrains back into the gas stream and has to be charged again. This results in a considerable loss of efficiency. Conversely, when the resistivity is higher than this, e.g., in the collection of highly resistive dusts, the dust particles act as electrical insulators and cannot conduct charges on the collected dust layer to the grounded electrode. As this condition progresses, the voltage drop across the dust layer increases, causing a drop in the applied voltage between the high voltage emitting wire and grounded electrode. Since high applied voltage is required to maintain corona current, the current also drops, causing the precipitator performance to deteriorate. As the voltage across the dust layer increases, eventually the dielectric strength of the dust layer is exceeded, back ionization occurs and the precipitator becomes no better than a settling chamber. However, when the particles are of the preferred resistivity, a balance is achieved between the tendency to have either overcharged or undercharged particles and optimum precipitation efficiency results.

The bulk resistivity of the particles to be conditioned can be determined, if desired, by measuring the bulk resistivity of a sample of such particles in accordance with the American Society of Mechanical Engineers Power Test Code No. 28 (ASME PTC 28) entitled "Determining the Properties of Fine Particulate Matter" (paragraph 4.05 describes the "Measurement of Resistivity" and Appendix FIGS. 7–10 describe the apparatus used for measuring the resistivity). Attempts to control the resistivity of the particles have been made with only limited success. For example, to this end, there have been injected into the gas stream various chemicals such as water, anhydrous ammonia, water and ammonia, sulfuric acid, sulfur trioxide, and phosphoric acid. These chemicals have usually been injected for reaction in situ with other chemicals naturally present in the gas stream with the hope that a conditioner would be formed in the gas stream. As a result, the resistivity of the particles in the gas has been of a random and uncontrolled nature and entirely dependent on the chemical composition of the gas and/or particles in the gas. Examples of and references to chemicals injected into the gas stream and the conditioner formed thereby may be found in the following patents: water—U.S. Pat. No. 2,746,563, Great Britain Pat. No. 932,895; ammonia—U.S. Pat. No. 1,291,745, U.S. Pat. No. 2,356,717; water and ammonia—U.S. Pat. No. 2,501,435, U.S. Pat. No. 3,523,407; sulfuric acid—U.S. Pat. No. 2,746,563, Great Britain Pat. No. 932,895, U.S. Pat. No. 2,602,734; sulfur trioxide—U.S. Pat. No. 2,746,563, Great Britain Pat. No. 932,895, Great Britain Pat. No. 933,286; and phosphoric acid—U.S. Pat. No. 3,284,990.

U.S. Pat. No. 3,523,407 describes a process for injecting water, ammonia and, when it is not present as a combustion product, $SO_3$, to alter the resistivity of entrained dust and make it easier to collect in an electrostatic precipitator. The water and ammonia are injected, preferably separately, prior to the passage of the flue gas through the preheater in an area where the temperature is at least 400° F. (204° C.) and preferably at least 450° F. (232° C.). The disadvantages of this approach are obvious. First, depending on the gas to be treated one needs either two or three complete injection systems, and one must handle at least one and sometimes two toxic gases. Second, a relatively large amount (i.e., 40–80 gals.) of water must be injected per million cubic feet of flue gas, and the amount of water must be varied depending on the $SO_3$ content of the gas being conditioned. Third, the conditioning depends on a chemical reaction occurring in the flue; e.g., a molecule each of ammonia, water and sulfur trioxide combining to form ammonium bisulfate.

U.S. Pat. No. 3,284,990 describes the use of phosphoric acids to reduce the resistivity of fly ash and enhance its collectability in an electrostatic precipitator. The phosphoric acids are formed in situ by injection of elemental phosphorus into the flue gas stream. The phosphorus burns to give phosphorus pentoxide which subsequently reacts with the water present in the flue gas and produces various phosphoric acids that act as the actual resistivity-modifying agents. The effectiveness of phosphorus is attributed to the extremely hygroscopic nature of phosphorus pentoxide initially formed. Because of its hygroscopicity, phosphorus pentoxide extracts water from the flue gas to form phosphoric acids which coat the fly ash particles with a highly conductive layer and thereby reduce the resistivity. It is also stated that the phosphoric acid is significantly less corrosive to boiler surfaces than sulfuric acid formed by the reaction of sulfur trioxide with water when sulfur trioxide is used as a fly ash conditioning agent.

The effects of phosphorus pentoxide on the performance of electrostatic precipitators have also been reported in a paper presented at the American Power Conference in April, 1977*. In this study precipitator power input was found to decrease with increasing phosphorus pentoxide content of the fly ash. The conclusion was drawn that "the presence of high levels of phosphorus in the fuel ash exerts a strong detrimental effect on precipitator electrical operation and plume opacity." This conclusion is in direct contrast to the observations of the present invention in which the use of phosphate salts as conditioning agents greatly enhances precipitator performance.

*A. B. Walker, *Operating Experience with Hot Precipitators on Western Low Sulfur Coals, American Power Converence,* Chicago, Ill., April, 1977.

Sodium salts have been used to reduce fly ash resistivity and enhance electrostatic precipitator performance, but in a manner different from that described in the present invention. This work, reviewed by R. E. Bickelhaupt**, involved the incorporation of $Na_2O$ as an integral part of fly ash by addition of sodium compounds to the coal before combustion, thereby lowering the bulk resistivity of fly ash produced from the coal. This method has the disadvantage of: (1) requiring an uneconomically high concentration of conditioner (up to 2.5% added $Na_2O$ based on the ash); (2) possibly increasing the fouling or slagging potential of the coal because of the high sodium concentration. In contrast, since the method of the present invention alters only the surface resistivity of the fly ash, a much lower conditioner concentration is required (typically equivalent $Na_2O$=0.11% of the ash at a rate of 300 grams of disodium phosphate per metric ton and an ash content of 12%). Also, since the conditioner is added to the flue gas stream well past the combustion zone of the boiler, it does not alter the slagging or fouling tendency of the fly ash.

**R. E. Bickelhaupt, *Sodium Conditioning to Reduce Fly Ash Resistivity,* Environmental Protection Agency Technology Serial, EPA-650/2-74-092, October, 1974.

Accordingly, an object of the present invention is to provide an improved method of conditioning a particle-laden gas stream to improve the collection characteristics of the particles entrained therein.

Another object is to provide such a method where only one injection system is needed to inject the conditioning agent.

A further object is to provide such a method where there is no necessity to handle one or more toxic gases.

It is also an object to provide such a method using a conditioning agent which is much less corrosive to boiler surfaces than either sulfuric or phosphoric acids.

It is a further object to provide a method which conditions the particle-laden gas stream using a much smaller quantity of conditioning agent than hitherto through possible and without the risk of boiler slagging or fouling.

To the accomplishment of the above, and to such other objects as may hereinafter appear, the present invention relates to the method of conditioning flue gas as defined in the appended claims and as described in this specification, taken together with the accompanying drawings, in which FIGS. 1 and 2 are graphical representations of the resistivities at various temperatures of untreated fly ash and fly ash treated with various substances.

SUMMARY OF THE INVENTION

It has now been found that the above and related objects of the present invention are obtained by a method of conditioning a particle-laden gas comprising the formation of a mixture of the particle-laden gas and finely divided ammonium or sodium phosphate salts such as $(NH_4)_2HPO_4$, $NH_4H_2PO_4$, $Na_2HPO_4$, $NaH_2PO_4$, $Na_3PO_4$ which contains 24-1200 grams of the phosphate salt per metric ton of coal burned to form the gas. Preferably the mixture contains 60–480 grams of phosphate salt per metric ton of coal burned to form the gas, this being a significantly low weight range compared to prior art additives. The phosphate salt may be added to the gas in the form of either a dry powder or an aqeous solution. The location of the area of injection of the phosphate salt into the flue gas stream should be chosen to provide adequate dispersal of the powder or volatilization and dispersal of the aqueous solution prior to passage of the flue gas stream through the electrostatic precipitator.

In a preferred embodiment, the collection characteristics of particles entrained in a particle-laden gas stream are improved for collection by an electrostatic precipitator by injecting finely divided diammonium phosphate as a 20–40% aqueous solution into a stream of particle-laden gas formed by the burning of coal. Sufficient diammonium phosphate is injected to provide 24–1200 and preferably 60–480 grams of diammonium phosphate per metric ton of coal burned to form the gas. After injection, the gas stream is directed through the heat exchange means and finally into the precipitator to collect the particles therein.

DETAILED DESCRIPTION OF THE PREFERRED EMBODIMENTS

The conditioners useful in the present invention are finely divided phosphate salts (e.g., diammonium phosphate, $(NH_4)_2HPO_4$; monoammonium phosphate, $NH_4H_2PO_4$; disodium phosphate, $Na_2HPO_4$; monosodium phosphate $NaH_2PO_4$; trisodium phosphate, $Na_3PO_4$, and mixtures thereof. The conditioner may be utilized either in dry form (for example, as a powder of finely divided particles) or preferably as an aqueous solution.

The amount of conditioner to be injected into the gas stream varies according to the amount of solids entrained in the gas stream and the degree of improvement needed in the electrostatic precipitator efficiency, for example, in order to meet a maximum allowable emissions requirement of a local, state or federal regulatory body. Generally for conditioning the fly ash in a coal-burning utility boiler, sufficient conditioner is injected into the gas stream to provide 24–1200, and preferably the quite low values of 60–480 grams of the conditioner agent (e.g., diammonium phosphate) per metric ton of coal burned to form the gas. Since the weight of flue gas is dependent on the weight of coal burned, another way of expressing this value is about 2.3–115, and preferably 5.8–46, parts by weight of conditioner per million parts by weight of flue gas, and in particular this would be an appropriate way to designate conditioner amount when the gas was not a product of coal combustion. Generally conditioner levels below this range do not appreciably improve the collection characteristics of the particles, while any conditioner levels in excess of the specified range not only increase the cost of conditioning unnecessarily, but also increase the possibility of blockage of the preheater or other heat exchanger downstream of the point of injection.

The quantity of conditioner determined according to the foregoing criteria is preferably added in the form of an atomized aqueous solution, preferably a 20–40% by weight solution, depending upon the solubility limits of the specific salt used. Higher or lower concentration may be used; however, as the function of the water is merely to facilitate injection of the conditioner in atomized form into the gas stream, and the water itself is not believed to play a significant part in the process of the present invention.

The mechanism by which the conditioner of the present invention changes the resistivity of the particles in the gas stream is not fully understood. One possible explanation is analogous to that advanced in U.S. Pat. No. 3,523,407, i.e., that the entrained dust particles become enveloped in a film or coating of the phosphate salt. Since the phosphate salt is a better conductor of electricity than the minerals normally present in fly ash, electric current can flow over the surface of the ash particles rather than through them. The effect of this phenomenon is to lower the apparent resistivity of the fly ash and improve its collectability by an electrostatic precipitator.

Figure 1:
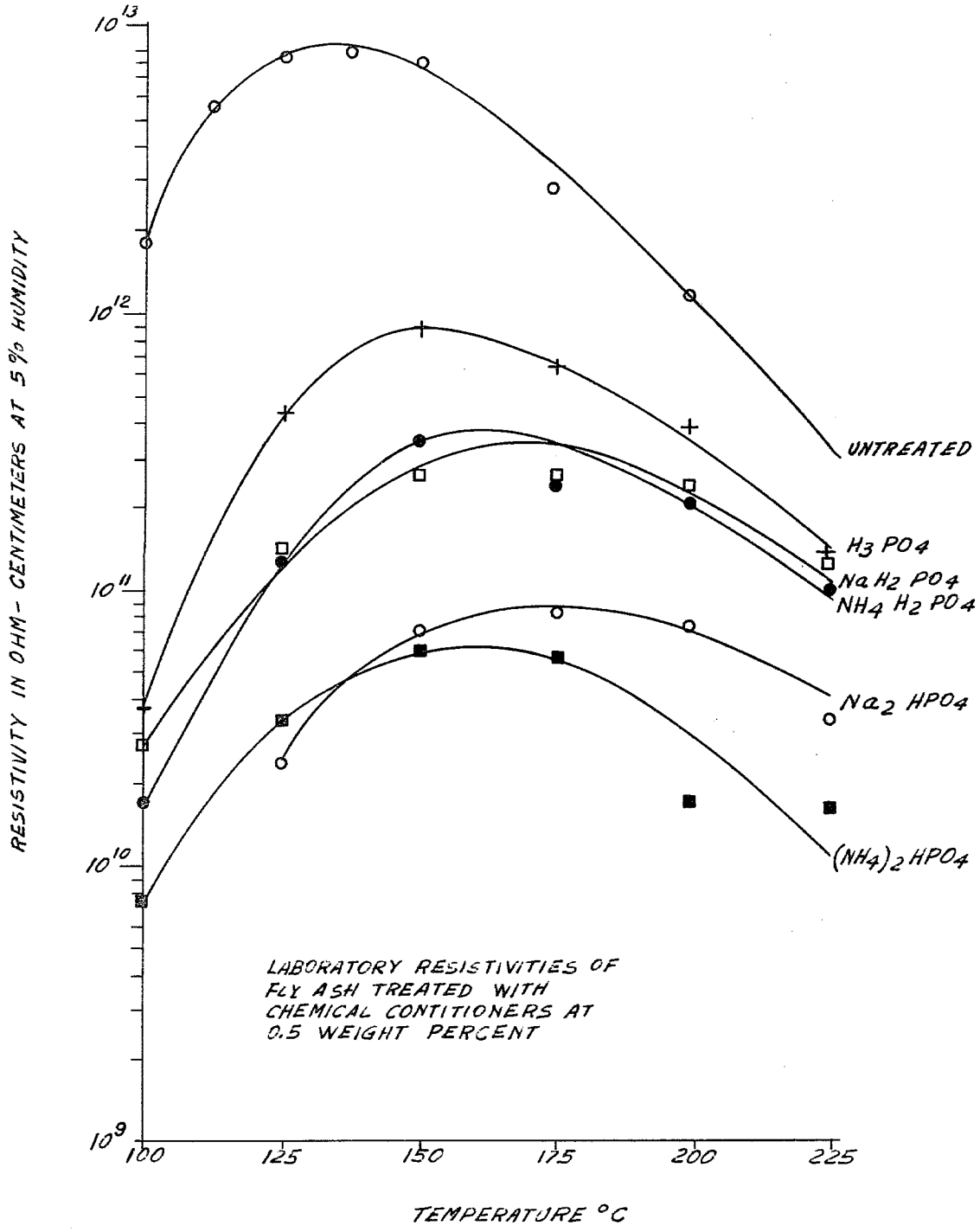

Regardless of the operative mechanism, it can be readily shown that the present method represents a significant improvement over previous methods employing phosphoric acids or combinations of reagents requiring in situ formation of the conditioner. FIG. 1 shows the results of laboratory resistivity determinations on fly ash coated with various conditioning agents at a level of 0.5 wt. % under controlled conditions. This level corresponds to a treatment rate of 500 g. of conditioner per metric ton of a coal containing 10 percent ash. Although phosphoric acid reduces the resistivity of the fly ash, several sodium and ammonium phosphate salts tested were even more effective. Within the range of 120°–160° C., the average operating temperature range of an electrostatic precipitator, diammonium phosphate, which is the preferred conditioner of the present invention, gave a resistivity of about $10^{11}$ ohm-cm, which is lower than the $10^{12}$ ohm-cm resistivity observed for phosphoric acid by a factor of more than ten. The other additives of the present invention show an improvement factor of five or greater. In addition, the conditioners of the present invention are less corrosive to boiler surfaces than either sulfuric or phosphoric acids.

Figure 2:
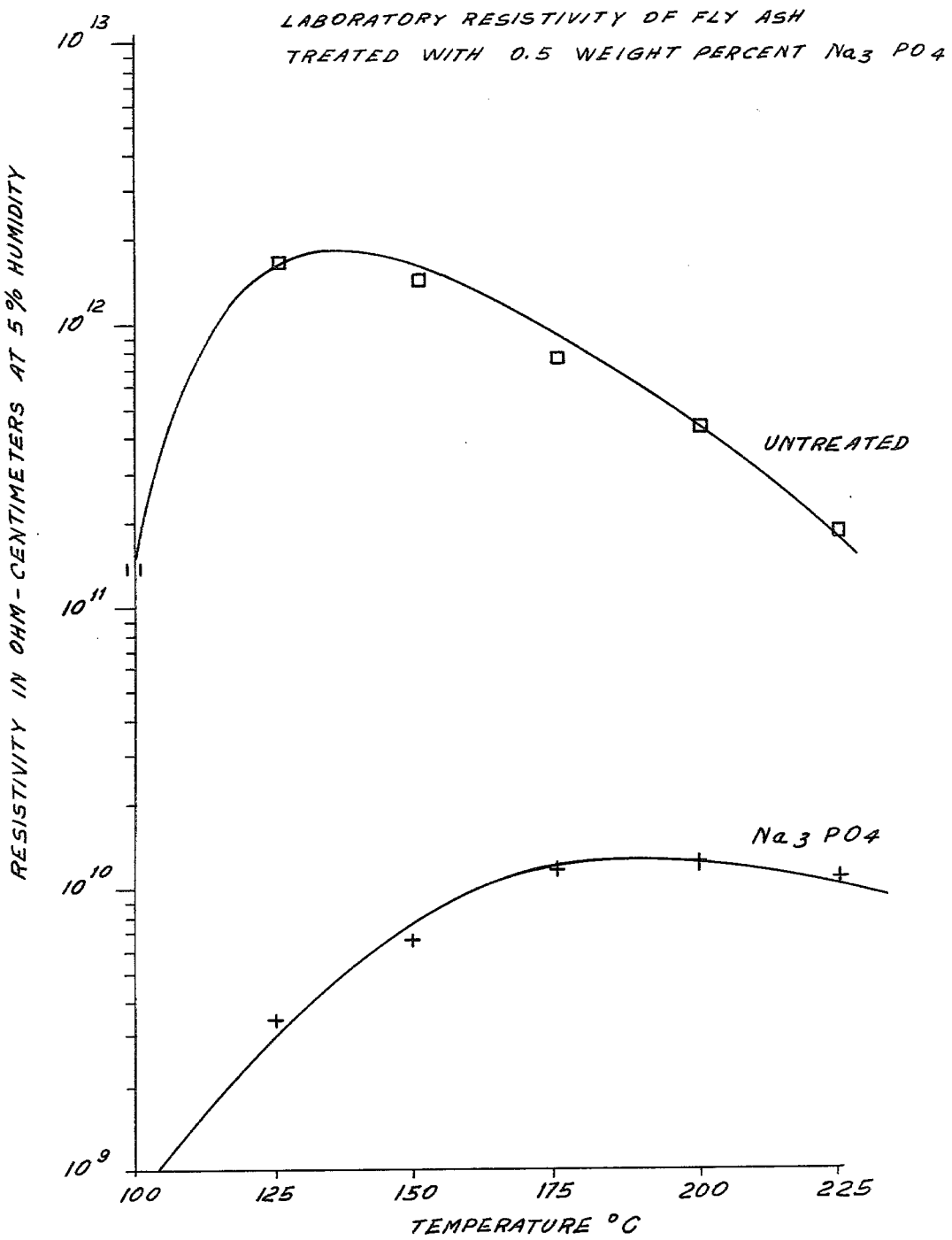

FIG. 2 shows the results of laboratory resistivity measurements on a different fly ash sample before and after treatment with $Na_3PO_4$ in accordance with the present invention. A decrease in resistivity by greater than a factor of 100 is indicated in the usual operating range of 125°–150° C.

Another important advantage of the present invention arises out of the fact that the conditioners are effective irrespective of the chemical content of the gas being conditioned; that is, their effectiveness does not depend on dust particles or the gas including a particular initial chemical substance (such as an oxide of sulfur) which would then combine with the condition in situ to condition the particles. Such dependency upon an in situ chemical reaction was one shortcoming of several of the heretofore known practices which required the presence of definite amounts of other chemical constituents in the gas stream, such a dependency being especially significant in view of the current trend to low sulfur fuels.

It will be recognized that an important feature of the present invention is the injection of the conditioner into a gas stream having the proper temperature range. It is probable that the gas temperature at the point of injection must be sufficiently high to insure proper volatilization of water carrier when present and dispersal of the conditioner prior to contact of the conditioner with the air preheater means or any other heat exchange unit which the conditioner might deposit upon and/or clog. When the gas stream at the point of injection is at least 200° C., the specified quantities of conditioner volatilize and disperse with sufficient speed for this purpose, but at least diammonium phosphate works well when injected at temperatures as low as 100°–120° C. Whether or not, or the extent to which, these temperatures produce volatilization of the water carrier is not known for certain, but the operability of the process at those temperatures is known. Of course, if there are not heat exchange units intermediate the point of injection and the collector, even somewhat lower injection temperatures may be tolerated provided they are effective to disperse the conditioner prior to its contact with the precipitator. However, the presence of an air preheater means or other heat exchange unit intermediate the point of injection and the precipitator is preferred to insure complete and thorough mixing of the dispersed conditioner and any of its decomposition products with the particles entrained in the gas stream.

The maximum temperature of injection should also be regulated since excessively high temperatures will result in decomposition of the conditioner to less effective reaction products. Loss of activity can also result from reaction of the conditioner with the fly ash, particularly when the conditioner is introduced into an area of the boiler where the fly ash is in a molten state. In general, a maximum of about 900° C. is appropriate. It is recommended that the injection amount and injection temperature be appropriately coordinated (within the ranges specified for the practice of the present invention) to insure the absence of deposits in the clogging of the heat exchange unit, higher injection amounts requiring higher injection temperatures according to the principles of the present invention.

In a typical power station, the flue gas produced by a coal-fired boiler passes successively from the boiler through a secondary superheater, a reheater-superheater, a "ball-room," a primary superheater, an economizer, an air preheater, a precipitator, a stack, and ultimately passes into the atmosphere. The temperature of the gas steam entering the ball-room is typically slightly under 900° C., and the temperature of the gas stream entering the air preheater is typically about 300° C. In this situation, the preferred location for the injection ports for the conditioner would be somewhere between the ball-room entry duct and the entrance to the air preheater. However, it is to be understood that this is only an illustrative example and that boilers vary widely in design and operating conditions. The criteria for selection of the injection ports include the temperature of the gas stream at such points, the accessibility of a location permitting good mixing of the conditioner (preferably atomized) with the gas stream, and the absence of direct impingement of the conditioner on the boiler tubing, since that might result in severe damage by thermally shocking the boiler tubing. Preferably, the injection ports are disposed so that the gas stream (containing the conditioner) subsequently passes through the air preheater or some other heat exchange unit to insure thorough mixing of the conditioner and the particles of the gas stream before the gas stream contacts the precipitator.

The apparatus for injecting the conditioner into the gas duct may be conventional in design. Apparatus for injecting the conditioner typically includes a supply of the conditioner, nozzle means communicating with the interior of the gas duct, and means connecting the conditioner supply to the nozzle means, such connecting means typically including means for forcing the conditioner through the nozzle, preferably as an atomized spray, and means for metering the amount of conditioner injected, typically in proportion to either the quantity of gas being conditioned or the quantity of coal being burned.

Preferably the conditioner is injected on a continuous basis during operation of the furnace, but clearly it may be alternatively injected on an intermittent or periodic basis.

The following examples will serve to illustrate the application of the present invention. Particulate emission levels, expressed in the examples as kilograms per hour, are conveniently measured by the procedure given in EPA Method #5 as described in the *Federal Register*, Vol. 36, No. 247, Part II, pp. 24, 888-24-890 (Dec. 23, 1971).

EXAMPLE I

A 125 Megawatt design capacity forced draft boiler with two Ljungstrom heaters had been equipped with an American Standard electrostatic precipitator designed for 98% efficiency at 125 Megawatts when burning a coal containing 4.6% sulfur and 15% ash. Because of environmental restrictions on $SO_2$ emissions, this boiler was switched to a coal containing 0.6% sulfur and 11% ash. While burning the high sulfur coal, precipitator efficiency had been quite good, but with the slow sulfur coal the particulate emissions reached an unacceptable level of 800-1000 kilograms per hour. To lower the emission level, a 25% aqueous solution of diammonium phosphate was injected into the superheat section of the boiler where the flue gas temperature was about 700° C.

As indicated by the data recorded in Table 1, for a treatment rate of 360 grams of diammonium phosphate per metric ton of coal burned, the particulate emissions were reduced to about 12% of the untreated level at equivalent boiler loads. This reduction in emissions was accomplished without significant increase in air heater differential pressure indicating that no air heater pluggage occurred during treatment.

In addition to particulate emission levels, in situ fly ash resistivity measurements were made. The observed reduction in fly ash resistivity from an untreated level of $7.88\times10^{11}$ ohm centimeters to $4.92\times10^{10}$ ohm centimeters during treatment accounts, at least in part, for the observed improvement in precipitator efficiency.

TABLE 1

| Treatment Rate Grams/Metric Ton | Emissions, Kilograms/Hour | Fly Ash Resistivity Ohm-Centimeters |
|---|---|---|
| None | 866 | $7.88 \times 10^{11}$ |
| 360 | 103 | $4.92 \times 10^{10}$ |

EXAMPLE II

A 390 Megawatt capacity balanced draft boiler was designed to burn coal containing 2.5% sulfur and 13% ash. After passing through two horizontal Ljungstrom air heaters, flue gas from the boiler was directed first through a mechanical fly ash collector and finally through an electrostatic precipitator. A change to coal containing only 1.2% sulfur resulted in a deterioration in precipitator performance, and, consequently, an increase in particulate emissions.

An improvement in precipitator efficiency was achieved by injection of a 25% aqueous solution of diammonium phosphate into the boiler in the superheat area where flue gas temperatures of 540°-620° were observed. The reduction in particulate emissions due to injection of diammonium phosphate into the flue gas is shown in Table 2. At equivalent boiler conditions particulate emissions were reduced by 24% from an untreated level of 306 kilograms per hour to a treated level of 234 kilograms per hour while using diammonium phosphate at a rate of 120 grams per metric ton of coal burned. In situ fly ash resistivity measurements showed a reduction from the untreated level of $1.72\times10^{11}$ ohm centimeters to $6.93\times10^{10}$ ohm centimeters during injection of diammonium phosphate.

TABLE 2

| Treatment Rate Grams/Metric Ton | Emissions, Kilograms/Hour | Fly Ash Resistivity Ohm-Centimeters |
|---|---|---|
| None | 306 | $1.72 \times 10^{11}$ |
| 120 | 234 | $6.93 \times 10^{10}$ |

EXAMPLE III

755 Megawatt balanced draft boiler with two Ljungstrom air heaters and a tubular air heater had been equipped with a Research Cottrell precipitator. In order to meet particulate emissions requirements the precipitator was designed for greater than 97% collection efficiency when burning coal containing 0.6% sulfur and 18-20% ash. Because of an increase in ash content of the coal to 21-24% and some deterioriation of the precipitator, collection efficiency had decreased to about 95%, which was insufficient to maintain compliance emission levels. In order to reduce the particulate emission level, a 25% aqueous solution of diammonium phosphate was injected into the primary superheat area of the boiler where the temperature was about 600°-700° C.

The data in Table 3 show that at a treatment rate of 120 g. of diammonium phosphate per metric ton of coal burned particulate emissions were reduced by 35% at equivalent boiler loads. This degree of improvement represented an increase in efficiency from the untreated level of 95% to about 96.7% which was sufficient to achieve compliance emission levels.

TABLE 3

| Treatment Rate, Grams/Metric Ton | Emissioons, Kilograms/Hour | Fly Ash Resistivity Ohm Centimeters |
|---|---|---|
| none | 2499 | $3.6 \times 10^{11}$ |
| 120 | 1631 | $2.3 \times 10^{11}$ |

Although a significant improvement in precipitator efficiency was observed during the injection of diammonium phosphate, fly ash resistivity measurements made in this case did not reveal a substantial change compared to untreated fly ash. It is not clear why, in this instance, the measured fly ash resistivity figures did not show a change of the same magnitude as in Examples I and II despite the fact that the precipitator efficiency was signficantly improved. There are, however, several other mechanisms which may be at work here—the diammonium phosphate may cause agglomeration of the particles, or the diammonium phosphate may affect the overall nature of the fluid system by producing a space charge effect which will aid the electrostatic precipitator. The precise mechanism here operative is not known, but the improvement in precipitator efficiency is marked.

From the above, it will be seen that the use of sodium and potassium phosphate salts as conditioning agents to improve the action of the electrostatic precipitator on particles entrained in a particle-laden gas, and particularly in a particle-laden flue gas has several significant advantages. They are useful over a very wide temperature range, they provide significant precipitation improvement even when used in quantities which are very low compared with prior art conditioners, they do not present the corrosion problems that many of the prior art conditioners present, they have no undesirable tendency toward boiler slagging or fouling, and they do not produce toxic or noxious gases.

Now that the preferred embodiments of the present invention have been shown and described, various modifications and improvements thereon will become readily apparent to those skilled in the art. Accordingly, the spirit and scope of the present invention is to be limited only by the appended claims, and not by the foregoing disclosure.

We claim:

1. A method of conditioning a particle-laden gas formed by the burning of coal comprising forming a mixture of:

(a) the particle-laden gas at a temperature of 100°-900° C., and (b) a finely divided substance selected from the group consisting of sodium and ammonium phosphate salts and mixtures thereof; said mixture containing 24-1200 grams of said substance per metric ton of coal burned to form said gas, and thereafter directing said gas stream into an electrostatic precipitator to collect said particles therein.

2. The method of claim 1, in which said substance comprises diammonium phosphate.

3. The method of claim 1, in which said substance comprises monoammonium phosphate.

4. The method of claim 1, in which said substance comprises disodium phosphate.

5. The method of claim 1, in which said substance comprises monosodium phosphate.

6. The method of claim 1, in which said substance comprises trisodium phosphate.

7. The method of claim 1 wherein said substance is mixed with said gas in the form of an aqueous solution.

8. The method of claim 7 wherein said aqueous solution comprises about 20-40 parts of said substance and 80-60 parts by weight of water.

9. The method of claim 1 wherein said substance is in the form of a dry powder.

10. The method of claim 1 wherein said mixture contains 60-480 grams of said substance per metric ton of coal burned to form said gas.

11. The method of claim 10 wherein said mixture contains 60-480 grams of diammonium phosphate per metric ton of coal burned to form said gas.

12. The method of claim 10 wherein said mixture contains 60-480 grams of monoammonium phosphate per metric ton of coal burned to form said gas.

13. The method of claim 10 wherein said mixture contains 60-480 grams of disodium phosphate per metric ton of coal burned to form said gas.

14. The method of claim 10 wherein said mixture contains 60-480 grams of monosodium phosphate per metric ton of coal burned to form said gas.

15. The method of claim 10 wherein said mixture contains 60-480 grams of trisodium phosphate per metric ton of coal burned to form said gas.

16. The method of claim 1 including the additional step of passing said mixture through heat exchange means.

17. The method of claim 1 wherein said substance is mixed with said gas in the form of an aqueous solution and in sufficient quantity to provide 2.3-115 parts by weight of said substance per million parts by weight of flue gas.

18. The method of claim 1 wherein said substance is mixed with said gas in the form of an aqueous solution and in sufficient quantity to provide 5.8-46 parts by weight of said substance per million parts by weight of flue gas.

19. A method of improving the collection chracteristics of particles entrained in a stream of particle-laden gas formed by the burning of coal for collection by an electrostatic precipitator, comprising the steps of:

(A) injecting a finely divided substance selected from the group consisting of sodium and ammonium phosphate salts and mixtures thereof into said stream of particle-laden gas while said gas has a temperature of 100°-900° C., sufficient substance being injected to provide 2.3-115 parts by weight of said substance per million parts by weight of gas; and (B) after said injection, directing said gas stream through a heat exchange means into an electrostatic precipitator to collect said particles therein.

20. The method of claim 19, in which said substance comprises diammonium phosphate.

21. The method of claim 19, in which said substance comprises monoammonium phosphate.

22. The method of claim 19, in which said substance comprises disodium phosphate.

23. The method of claim 19, in which said substance comprises monosodium phosphate.

24. The method of claim 19, in which said substance comprises trisodium phosphate.

25. The method of claim 14 wherein said substance is injected in the form of an aqueous solution.

26. The method of claim 25 wherein said aqueous solution comprises about 20-40 parts of said substance and 80-60 parts by weight of water.

27. The method of claim 19 wherein said substance is injected in the form of a dry powder.

28. The method of claim 19 wherein 60-480 grams of said substance are injected per metric ton of coal burned to form said gas.

29. The method of conditioning a particle-laden gas comprising forming a mixture of:

(a) a particle-laden gas at a temperature of 100°-900° C., and (b) finely divided diammonium phosphate, said mixture containing 2.3–115 parts by weight of said diammonium phosphate per million parts by weight of said gas, and thereafter directing said gas stream into an electrostatic precipitator to collect said particles therein.

30. A method of improving the collection characteristics of particles entrained in a particle-laden gas stream for collection by an electrostatic precipitator, comprising the steps of:

(a) injecting a finely divided substance selected from the group consisting of sodium and ammonium phosphate salts and mixtures thereof into a stream of particle-laden gas while said gas has a temperature of 100°–900° C., sufficient such substance being injected to provide 2.3–115 parts by weight of said substance per million parts by weight of said gas;

(b) after said injection, directing said gas stream through a heat exchange means and into an electrostatic precipitator to collect said particles thereon.

31. The method of claim 30, in which said substance comprises diammonium phosphate.

32. The method of claim 30, in which said substance comprises monoammonium phosphate.

33. The method of claim 30, in which said substance comprises disodium phosphate.

34. The method of claim 30, in which said substance comprises monosodium phosphate.

* * * * *

Disclaimer 4,306,885.—*Alfred E. Kober,* Hopatcong; and *Ira Kukin,* West Orange, N.J. METHOD OF CONDITIONING FLUE GAS. Patent dated Dec. 22, 1981. Disclaimer filed Mar. 10, 1983, by the assignee, *Economics Laboratory, Inc.*

Hereby enters this disclaimer to all claims of said patent.

[*Official Gazette May 10, 1983.*]